United States Patent [19]

Park

[11] Patent Number: 5,061,876

[45] Date of Patent: Oct. 29, 1991

[54] SURFACE DISCHARGE-TYPE PLASMA DISPLAY PANEL USING A GLASS PLATE

[75] Inventor: Yong S. Park, Kyungsangbook-do, Rep. of Korea

[73] Assignee: Goldstar Co. Ltd., Seoul, Rep. of Korea

[21] Appl. No.: 430,936

[22] Filed: Nov. 2, 1989

Related U.S. Application Data

[63] Continuation of Ser. No. 140,098, Dec. 31, 1987, abandoned.

[30] Foreign Application Priority Data

Dec. 31, 1986 [KR] Rep. of Korea ..... 11740/1986

[51] Int. Cl.[5] ..... H01J 17/49

[52] U.S. Cl. ..... 313/581; 313/583; 313/584; 313/586; 313/587

[58] Field of Search ..... 313/494, 581, 583, 584, 313/586, 587; 315/169.1, 169.4

[56] References Cited

U.S. PATENT DOCUMENTS

| | | | |
|---|---|---|---|
| 3,873,870 | 3/1975 | Fukvshima et al. | 315/169.1 |
| 4,113,896 | 9/1978 | Reiner et al. | 313/583 |
| 4,689,617 | 8/1987 | Costa et al. | 315/169.4 |

*Primary Examiner*—Donald J. Yusko
*Assistant Examiner*—Michael Horebik

[57] ABSTRACT

A surface discharge-type plasma display panel having a glass plate including an X-electrode base that is positioned on the glass plate, a plurality of X-electrodes that are inserted vertically into the glass plate, and Y-electrodes that are each arranged around the corresponding X-electrodes in the shape of a "C" or an "O". This structure reduces the possibility of a dielectric breakdown.

4 Claims, 3 Drawing Sheets

SURFACE DISCHARGE-TYPE PLASMA DISPLAY PANEL USING A GLASS PLATE

This application is a continuation of application Ser. No. 140,098, filed on Dec. 31, 1987, now abandoned.

BACKGROUND OF THE INVENTION

1. Field of the Invention

The present invention relates to a surface discharge-type plasma display panel, and more particularuly to a plasma display panel with a high resolution. In the plasma display panel, a dielectric plate is formed of a thin glass plate of 1~2 mm thick, and X and Y-electrodes are formed on the same level of the glass plate, so as to thoroughly prevent the possibility of a dielectric breakdown at the intersecting point of the X and Y-electrodes.

2. Description of the Prior Art

Referring to FIGS. 1 and 2, there are shown two conventional surface discharge-type plasma display panels. As shown in FIG. 1, the conventional two dimensional surface discharge-type plasma display panel comprises a glass plate (1), an X-electrode (2) placed on the glass plate (1), Y-electrodes (4) on a first dielectric (3) that coats the X-electrode (2), a second dielectric (5) that coats the Y-electrodes (4), a MgO-layer (6) that coats the second dielectric (5), and an upper glass plate (8) positioned above the second dielectric (5). A discharging space (7) is formed between the MgO-layer (6) and the upper glass plate (8). However, the thickness of the first dielectric (3), or the intersecting point of the X and Y-electrodes (2,4) is limited to the range of 15~50 μm, whereby a dielectric breakdown would occur. If the thickness of the first dielectric (3) is made to be more thick, for preventing a dielectric breakdown, then a decrease of the brightness and the misdischarge results.

As shown in FIG. 2, the conventional three dimensional surface discharge-type plasma display panel comprises a glass plate (11) as a base plate, X-electrodes (12) and Y-electrodes (13) that are positioned on the glass plate (11), a dielectric (14) coated on the X- and Y-electrodes (12, 13), a third electrode, or an electrode (15) that is arranged on the dielectric (14), a MgO-layer (16) formed on the electrode (15), and an upper glass plate positioned above the MgO-layer (16) which provides a discharging space (17) there between. The arrangement of the electrodes in FIG. 2 is similar to that of the electrodes in FIG. 1. If a voltage is applied to the X-electrodes (12), a potential distribution will be formed between the X-electrodes (12) and the electrode (15) by the dielectric (14), as shown by a first dotted line (19) in FIG. 2 (B). Similarly, if an opposite voltage is applied to Y-electrodes (13), then a potential distribution will occur between the Y-electrodes (13) and the X-electrodes (12), as shown by a second dotted line (20) in the FIG. 2 (B). Therefore, the dielectric breakdown may sometimes occur in parts of the dielectrics in the prior art structure of FIG. 2. In addition, a high resolution cannot be obtained due to the parallel arrangement of the X and Y-electrodes (12, 13) that are positioned in the same plane.

SUMMARY OF THE INVENTION

Accordingly, an object of the invention is to provide a plasma display panel with a high resolution wherein the X and Y-electrodes are arranged in the same plane on a laminated dielectric glass plate, without the use of a dielectric so that the possiblity of a dielectric breakdown is reduced.

According to the present invention, the surface discharge-type plasma display panel comprises an X-electrode base formed on a glass plate, a plurality of X-electrodes connected to the said base where each of the X-electrodes penetrate into the glass plate so that the upper and lower ends of the electrodes protrude out of the opposite surfaces of the glass plate, Y-electrodes positioned around the X-electrodes and are respectively connected to each other, a dielectric and a MgO-layer positioned above the glass plate, and an upper glass plate positioned above the MgO-layer for providing a discharging space therebetween. Furthermore, the X-electrodes are all connected to a plurality of X-electrode connectors having lower ends that are also connected to the X-electrode base so that the X-electrodes are finally connected to the base through the connectors.

Beneath the surface of each X-electrode connector, a metal selected from a group comprising silver, gold, platinum, etc, coats the surface to improve the electrical connecting effect with the X-electrode base.

The Y-electrodes are respectively positioned around the X-electrodes in a shape of "C" or "O".

BRIEF DESCRIPTION OF THE DRAWINGS

These and other advantages of the present invention will become apparent from the following disclosure taken in conjunction with FIG. 3 to FIG. 8, wherein preferred constructions of two embodiments of the invention are set forth by way of example.

FIG. 3 to FIG. 5 show a first embodiment of the present invention;

FIG. 3 is a sectional view of the surface discharge-type plasma display panel;

FIG. 6 to FIG. 8 show a second embodiment of the present invention;

FIG. 6 is a partial sectional view of the panel;

FIG. 8 is a schematic view showing the base of the glass plate.

DETAILED DESCRIPTION OF THE PREFERRED EMBODIMENT

Figure 1:
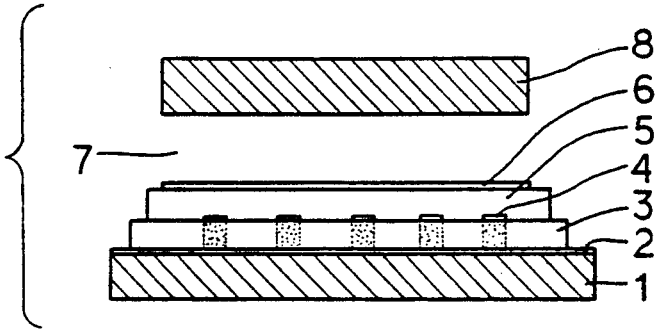
FIG. 1 PRIOR ART
FIG. 1 is a sectional view of the conventional two dimensional surface discharge-type plasma display panel.
Figure 2A:
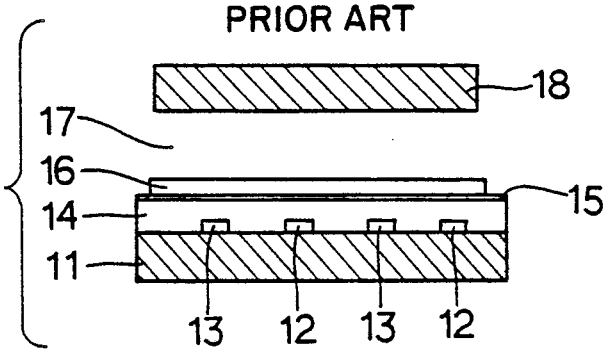
FIG. 2(A) PRIOR ART
FIG. 2(A) is a sectional view of the conventional three dimensional surface discharge-type display panel.
Figure 2B:
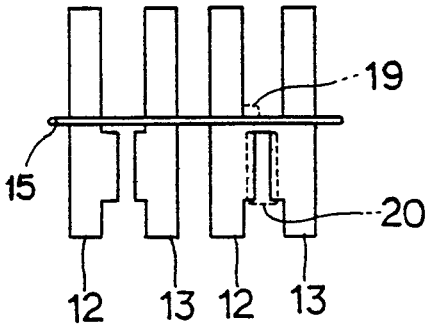
FIG. 2(B) PRIOR ART
FIG. 2(B) is a top view showing the arrangement of the electrodes of FIG. 2(A)
Figure 3:
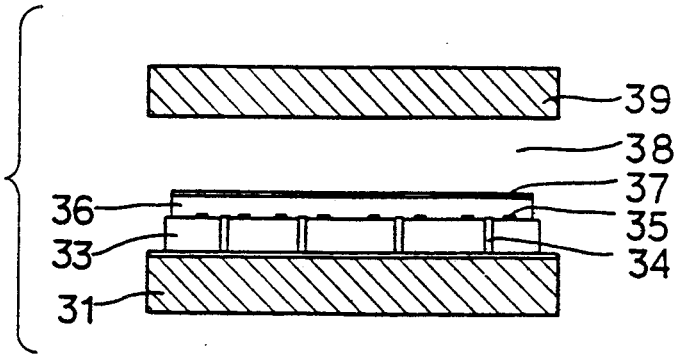
Figure 4A:
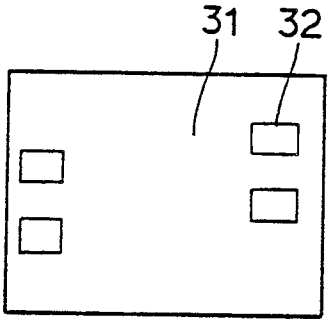
FIG. 4(A) is a top view of a glass plate.
Figure 4B:
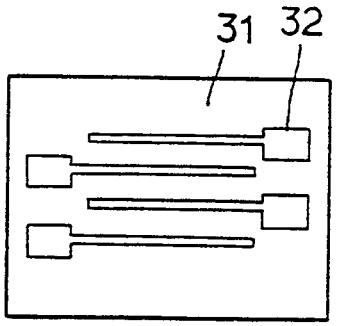
FIG. 4(B) is a top view of another glass plate.
Figure 5A:
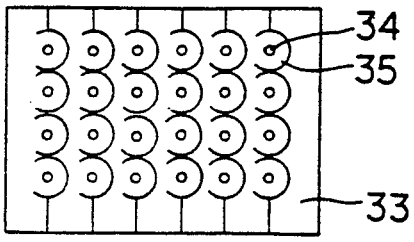
FIG. 5(A) is a top view showing the arrangement of the electrodes.
Figure 5B:
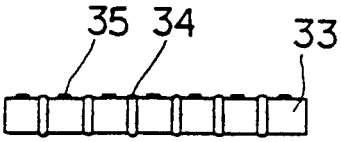
FIG. 5(B) is a sectional view of FIG. 5(A)

As shown in FIG. 3 to FIG. 5, a surface discharge-type plasma display panel according to the first embodiment is shown having an X-electrode base (32) that is mounted on the glass plate (31), and a dielectric glass plate (33) is placed on the surface of the glass plate (31).

Each of the X-electrodes (34) penetrates into the corresponding openings that are punched in the dielectric glass plate (33), and the X-electrodes (34) are arranged such that all of their lower ends contact the X-electrode base (32). Next, Y-electrodes (35) are mounted on the plate (33). A dielectric (36) and a MgO-layer (37) coat the dielectric glass plate (33), and an upper glass plate (39) is positioned above the MgO-layer (37) for providing a discharging space (38) therebetween.

According to the first embodiment, the X-electrodes (34) and the Y-electrodes (35) are all eventually positioned in the same plane of the glass plate (33) and a potential distribution therebetween is also produced in the same plane, the dielectric breakdown of the dielectric (36) can thereby be prevented.

As shown in FIG. 5, the relative arrangement of the X-electrodes (34) and the Y-electrodes (35) are positioned in the same plane respectively and the Y-electrodes (35) are positioned around the X-electrodes (34) in the shape of "C", with the Y-electrodes (35) being connected to each other. Therefore, in such an arrangement, because the Y-electrodes (35) are connected to each other but are not arranged in parallel, a, mis-operation that may result from the discharge between the adjacent electrodes can be prevented, thereby the resoluting power can be maximized.

Referring to FIG. 4, there are two embodiments for forming the X-electrode base (32) on the glass plate (31). The two embodiments are similar to each other except for the fact that the contacting surface of the base (32) in FIG. 4 (B) is larger than that of FIG. 4(A).

Figure 6:
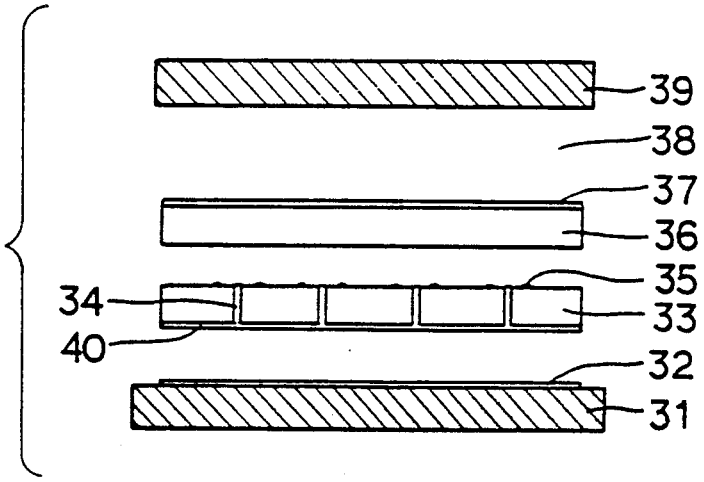
Figure 7A:
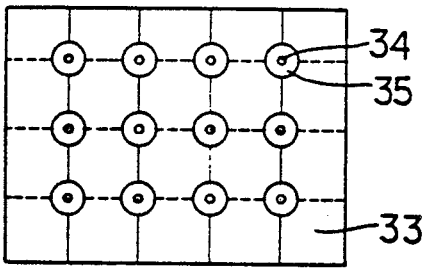
FIG. 7(A) is a top view showing the arrangement of electrodes.
Figure 7B:
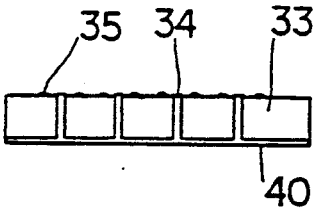
FIG. 7(B) is a sectional view of FIG. 7(A)
Figure 8:
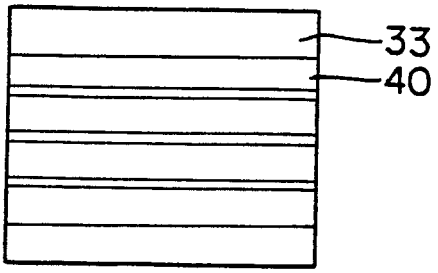

As shown in FIG. 6 to FIG. 8 which disclose another embodiment of the display panel, the present embodiment is similar to the previous embodiments by the fact that the X-electrode base (32) is positioned on the glass plate (31), and a glass plate (33) is positioned the X-electrode base (32).

A plurality of small openings are punched in the glass plate (33), and plurality of X-electrodes (34) are inserted into the corresponding openings, respectively, so that the opposite ends of the electrodes (34) protrude out of the openings. The lower ends of the X-electrodes (34) are all finally connected to X-electrode connectors (40). In order to improve the connecting effect to the X-electrode base (32), a metal such as silver, gold, or platinum, etc. is coated on the lower surface of the connector (40).

Accordingly, the X-electrode construction comprises an X-electrode base (32), plurality of X-electrodes, and X-electrode connectors (40). On the glass plate (33), Y-electrodes (35), dielectric (36), MgO-layer (37) and an upper glass plate (39) are arranged in order. A discharging space (38) is formed between the upper glass plate (39) and the MgO-layer (37).

According to the present embodiment, X-electrodes (34) and Y-electrodes (35) are all positioned in the same plane of the glass plate (33), and the potential distribution between the X and Y-electrodes (34,35) is also produced in the same plane, so that the dielectric breakdown of the dielectric (36) can be prevented.

As shown in FIG. 7, the relative arrangement of the X and Y-electrodes (34, 35) in the same plane of the glass plate (33) is shown. The Y-electrodes (35) are circularly arranged around the X-electrodes (34) respectively, and are connected to each other. Such an arrangement can maximize the resoluting power, because the Y-electrodes (37) are not positioned in parallel, but the Y-electrodes are connected to each other.

Referring to FIG. 8, the arrangement of the X-electrode connectors (40) under the glass plate (33) is shown. The X-electrode connectors (40) are coated with precious metals such as silver, gold or platinum to improve the electrical connecting effect.

According to the present embodiment, the panel may not have a dielectric (36) and a MgO-layer (37). Instead, the surface of the electrodes can be coated with a metal such as nickel, platinum, gold, etc. for use as a direct current surface discharge-type plasma display in which the X-electrode is a cathode and the Y-electrode is an anode.

While only certain embodiments of the present invention have been described, it will be apparent to those skilled in the art that various changes and modifications may be made therein without departing from the spirit and scope of the present invention as claimed.

What is claimed is:

1. A structure for a surface discharge-type plasma display panel comprising:

a lower glass plate layer having a top surface;

an X-electrode base layer having an upper surface and a lower surface opposite to said upper surface, said lower surface being disposed on said top surface of said lower glass plate layer;

a pattern of a plurality of X-electrode connectors formed over said upper surface of said X-electrode base layer;

a connector enhancing layer disposed on said upper surface of said X-electrode base layer and said pattern of said plurality of X-electrode connectors;

a first dielectric glass plate layer disposed over said X-electrode base layer, said connector enhancing layer and said pattern of said plurality of X-electrode connectors, having a plurality of openings vertically extending towards said X-electrode base layer;

a plurality of X-electrodes disposed in a plane on said first dielectric glass plate layer and extending vertically through said plurality of openings to connect said plurality of X-electrodes as defined by said pattern of said plurality of X-electrode connectors;

a plurality of Y-electrodes disposed in said plane on said first dielectric glass plate layer corresponding to each of said plurality of X-electrodes and each of said plurality of Y-electrodes are respectively positioned around one of said plurality of X-electrodes in a C shape;

a second dielectric layer disposed on said first dielectric glass plate layer and said plurality of X- and Y-electrodes; and an upper glass plate layer positioned above said second dielectric layer for providing a discharging space between said upper glass plate layer and said second dielectric layer.

2. A structure for a plasma display panel according to claim 1, wherein said connector enhancing layer comprises a metal selected from the group consisting of silver, gold and platinum to improve the electrical contacting effect between said X-electrode base layer and said plurality of X-electrode connectors.

3. A structure for a plasma display panel according to claim 1, wherein said second dielectric layer comprises a first layer of a dielectric material and a second layer of MgO disposed on said first layer.

4. A structure for a surface discharge-type plasma display panel comprising:

an X-electrode base layer having a top surface;

a pattern of a plurality of X-electrode connectors formed over said top surface of said X-electrode base layer;

a connector enhancing layer disposed on said top surface of said X-electrode base layer and said pattern of said plurality of X-electrode connectors;

a first dielectric glass plate disposed over said top surface of said X-electrode base layer, said connector enhancing layer and said pattern of said plurality of X-electrode connectors, having a plurality of openings vertically extending towards said top surface of said X-electrode base layer;

a plurality of X-electrodes disposed in a plane on said first dielectric glass plate layer and extending vertically through said plurality of openings to connect said plurality of X-electrodes as defined by said pattern of said plurality of X-electrode connectors; and a plurality of Y-electrodes disposed in said plane on said first dielectric glass plate layer corresponding to each of said plurality of X-electrodes and each of said plurality of Y-electrodes are respectively positioned around one of said plurality of X-electrodes in a C shape.

* * * * *